United States Patent [19]

Kilinskas et al.

[11] 4,296,512

[45] Oct. 27, 1981

[54] METHOD FOR MAKING FASTENERS

[75] Inventors: William A. Kilinskas, Amherst; Ronald J. Selines, Yorktown Heights; Jaak S. Vand den Sype, Scarsdale, all of N.Y.

[73] Assignee: Union Carbide Corporation, New York, N.Y.

[21] Appl. No.: 93,014

[22] Filed: Nov. 9, 1979

[51] Int. Cl.[3] ..... B21K 1/48

[52] U.S. Cl. ..... 10/27 E; 148/12 E

[58] Field of Search ..... 10/1 R, 10 R, 27 R, 10/27 E, 162 S; 148/12 E, 12.3, 12.4, 38, 125; 72/342, 270, 271, 286

[56] References Cited

U.S. PATENT DOCUMENTS

| | | | |
|---|---|---|---|
| 3,072,933 | 1/1963 | Carlson | 10/27 E |
| 4,042,421 | 8/1977 | Van den Sype et al. | 148/12 E |
| 4,204,885 | 5/1980 | Van den Sype | 148/12 E X |

OTHER PUBLICATIONS

Plastic Deformation of Heat Resisting Metals & Special Alloys, Pavlov et al, Nauka Publishers, 1970.

*Primary Examiner*—Mark Rosenbaum
*Attorney, Agent, or Firm*—Saul R. Bresch

[57] ABSTRACT

A method for making a fastener having a head and a shank from wire or rod consisting essentially of AISI 200 or 300 series stainless steel comprising the following steps:

(a) cooling the wire or rod to a temperature of less than about minus 75° C.;

(b) drawing the cold wire or rod through a die at a strain sufficient to provide a tensile strength for the wire or rod in the range of about 75 ksi to about 160 ksi, the strain and the die size being such that the area of the wire or rod will be reduced by at least about 3 percent; and (c) dividing the wire or rod into slugs and cold heading each slug to provide the fastener.

9 Claims, No Drawings

METHOD FOR MAKING FASTENERS

FIELD OF THE INVENTION

This invention relates to a process for making fasteners and, more particularly, to those fasteners having a head and a shank.

DESCRIPTION OF THE PRIOR ART

It is not surprising that high strength fasteners or bolts are advantageous, especially so when, in addition to high tensile strength, they are tough, corrosion-resistant, resistant to stress corrosion cracking, and readily cold forgable (formable) with minimum tool wear, all at reasonable cost. To an engineer/designer these properties are translatable into increased fatigue life, smaller light-weight fasteners, increased clamping loads, increased shear strength, and higher load carrying capacities per fastener.

One class of materials commonly used for fasteners are stainless steels of the AISI 300 series. These steels have excellent formability and corrosion resistance and are widely available at a reasonable cost. In fact, they have all of the above enumerated advantages with one reservation, i.e., the commercially available tensile strengths, while high, are not greater than about 140 ksi (kilopounds per square inch) or 966 Mpa (megapascals). This deficiency comes about because the 300 series stainless steels cannot be hardened, and thus strengthened, by the inexpensive heat treating route. Rather, strength is achieved by mechanical working which occurs during extrusion of the shank portion of the bolt during cold forging, or by starting with a cold drawn wire. Unfortunately, cold drawing of the starting wire can only be used to a limited extent since it is accompanied by a decrease in ductility and a rise in flow stress of the wire, which results in difficulties in the upsetting of the bolt heads and in increased die wear. In view of the limitations on the extent to which the cold drawing can be carried out and the limited amount of available strengthening during extrusion, the AISI 300 stainless steels can only be strengthened up to about 140 ksi (966 Mpa), at least by those techniques which have commercial practicability.

SUMMARY OF THE INVENTION

An object of the invention, therefore, is to provide a method for making fasteners of AISI 200 and 300 stainless steel whereby tensile strengths greater than about 140 ksi (966 Mpa) can be achieved without encountering difficulties in the upsetting of the head portion or excessive die wear during such operations.

Such a method for making a fastener having a head and a shank from wire or rod consisting essentially of AISI 200 or 300 series stainless steel has been discovered comprising the following steps:

(a) cooling the wire or rod to a temperature of less than about minus 75° C.;

(b) drawing the cold wire or rod through a die at a strain sufficient to provide a tensile strength for the wire or rod in the range of about 75 ksi to about 160 ksi, the strain and the die size being such that the area of the wire or rod will be reduced by at least about 3 percent; and (c) dividing the wire or rod into slugs and cold heading each slug to provide the fastener.

DESCRIPTION OF THE PREFERRED EMBODIMENT

The fastener having a head and a shank can, with minor exceptions, be equated with the common bolt, whether in a threaded or unthreaded state. Other fasteners contemplated here are screws and rivets. The process is also particularly suited for forming axisymmetrical components where high strength is desired in combination with good cold heading properties. Examples of such components are various types of pins, axles, and plungers.

The AISI Series Designation 200 and 300 stainless steels are described in the "Steel Products Manual: Stainless and Heat Resisting Steels" published by the American Iron and Steel Institute (AISI), now of Washington, D.C., in 1974. These stainless steels are austenitic and, at least initially, have an $Md_{30}$ temperature of no higher than about 100° C. (i.e., plus 100° C.) and an Ms temperature no higher than minus 100° C. AISI stainless steels, which have an $Md_{30}$ temperature above about minus 50° C. and below about 50° C. such as 304, 304 L, 302 HQ, 302, 303, 303 Se, 301, 305, 316, 316 L, 321, 347, 384, and 385 are examples of the 300 series preferred for subject process.

The term "austenitic" involves the crystalline microstructure of the alloy, which is referred to as austenitic when the microstructure has a face-centered cubic structure. The other microstructure with which we are concerned here is a body-centered cubic structure and is referred to as martensitic or martensite.

The $Md_{30}$ temperature is defined as the temperature at which a true strain of 30 percent results in a microstructure containing 50 percent retained austenite and 50 percent transformed martensite. True strain is defined as the natural logarithm of the ratio of the final length of the rod or wire divided by its initial length prior to mechanical deformation. The $Md_{30}$ temperature can be determined by a conventional tensile test carried out at various temperatures. Examples of the determination of the $Md_{30}$ temperature for various austenitic stainless steels are given in a paper entitled: "Formation of Martensite in Austenitic Stainless Steels" by T. Angel appearing in the Journal of the Iron and Steel Institute, May 1954, pages 165 to 174. This paper also contains a formula for calculating the $Md_{30}$ temperature from the steel's chemistry:

$$Md_{30}(°C.) = 413 - 462[(C+N)] - 9.2[Si] - 8.1[Mn] - 13.7[Cr] - 9.5[Ni] - 18.5[Mo]$$

where the quantities in square brackets denote the weight percentages of the elements present. This formula can be employed as a useful guideline for the $Md_{30}$ temperature.

The Ms temperature is defined as the temperature at which martensitic transformation begins to take place spontaneously, i.e., without the application of mechanical deformation. The Ms temperature can also be determined by conventional tests.

Some examples of $Md_{30}$ temperatures are as follows:

| AISI stainless steel type no. | $Md_{30}$ temperature (°C.) |
|---|---|
| 301 | 43 |
| 302 | 13 |
| 304 | 15 |

-continued

| AISI stainless steel type no. | $Md_{30}$ temperature (°C.) |
|---|---|
| 304L | 18 |

Physical properties relevant to the present invention include those of strength and toughness. The strength property can readily be determined from a simple uniaxial tensile test as described in ASTM standard method E-8. This method appears in part 10 of the 1974 Annual Book of ASTM Standards published by the American Society for Testing and Materials, Philadelphia, Pa. The results of this test on a material can be summarized by stating the yield strength, tensile strength, and total elongation of the material: (a) the yield strength is the stress at which the material exhibits a specified limiting deviation from the proportionality of stress to strain. In this specification the limiting deviation is determined by the offset method with a specified 0.2 percent strain; (b) the tensile strength is the maximum tensile stress which the material is capable of sustaining. Tensile strength is the ratio of the maximum load during a tension test carried to fracture to the original cross sectional area of the specimen; and (c) the total elongation is the increase in gauge length of a tension test specimen tested to fracture, expressed as a percentage of the original gauge length. It is generally observed that when the yield and tensile strengths of metallic materials are increased through metallurgical processes, the total elongation decreases.

The wire or rod, prior to cooling step (a), can be either annealed or cold drawn, and for optimum results should have a tensile strength of at least about 75 ksi (483 Mpa) and not more than about 125 ksi (863 Mpa). The term "cold drawn" means wire or rod which has been drawn through a die causing a reduction in the diameter of the wire or rod, such reduction taking place with both the die and incoming wire or rod at atmospheric temperature. Typically, a 0 to 30 percent reduction in area of annealed wire or rod by cold drawing will result in a tensile strength in this range. The selection of a tensile strength within the 75 to 125 ksi range is related to alloy chemistry and to the desired final fastener strength, and is generally made by the operator based on his experience with a particular alloy. In general, wire or rod with a tensile strength of 75 to 100 ksi would be selected for fasteners with a final strength of less than about 200 ksi, and wire or rod with a tensile strength of 100 to 125 ksi for fasteners with a final strength greater than about 200 ksi. A slightly cold drawn wire or rod may be selected in any case as a means of introducing lubricant on the wire to facilitate steps (b) and (c) of subject process.

The temperature at which step (a) is conducted is less than about minus 75° C. and is, preferably, less than about minus 100° C. These temperatures can be achieved by carrying out the step in liquid nitrogen (B.P. minus 196° C.); liquid oxygen (B.P. minus 183° C.); liquid argon (B.P. minus 186° C.); liquid neon (B.P. minus 246° C.); liquid hydrogen (B.P. minus 252° C.); or liquid helium (B.P. minus 269° C.). Liquid nitrogen is preferred. A mixture of dry ice and methanol, ethanol, or acetone has a boiling point of about minus 79° C. and can also be used. The lower the temperature, the less the strain needed for each percent of improvement in tensile strength in step (b). It should be noted here that deformation introduces energy into the material and this causes a rise in temperature.

The wire or rod, which has been cooled in step (a) is then, in step (b), drawn through a die at a strain sufficient to provide a tensile strength for the wire or rod higher than its incoming tensile strength and in the range of about 75 ksi (518 Mpa) to about 160 ksi (1104 Mpa) and preferably in the range of about 90 ksi (621 Mpa) to about 160 ksi (1104 Mpa). In addition to achieving the aforementioned tensile strengths, the area of the wire or rod must be reduced by at least about 3 percent. The area reduction is preferably in the range of about 3 percent to about 25 percent, and is accomplished by providing a die of a particular size, the size depending on the area reduction desired relative to the diameter of the initial wire or rod. Step (b) results in the formation of at least about 5 percent and not more than about 40 percent martensite, which enhances the strengthening response of the material due to extrusion of the shank during cold heading and significantly increases the aging response of the finished fastener.

Both the drawing step and the die are conventional and can be typically described as follows. To take full advantage of the temperature to which the wire or rod is cooled in step (a), steps (a) and (b) should be so coordinated that the time interval between the two steps is short enough to substantially avoid any temperature rise above the cooling temperature of step (a). In any case, the temperature of the wire of rod should not be permitted to rise higher than about minus 75° C.

The dies which may be used in step (b) are conventional, e.g., tungsten carbide drawing dies. The cone angle of the carbide nib is found to be optimally about 12 degrees. Larger die angles give rise to an excessive amount of redundant work of deformation resulting in less than optimum properties. Die angles smaller than 12 degrees have too large a bearing length and the increased friction between die and metal is also found to provide less than optimum properties particularly with respect to torsional yield.

The lubricants used for the wire and which are applied prior to drawing are also conventional. Typically, prior to step (a), the wire is precoated with lubricant. This precoat is applied by dipping the coils in standard precoat solutions. These solutions may contain lime or oxalate. Prior to entering the die in step (b), and after step (a), the wire passes through a box filled with a dry soap such as calcium stearate soap. To enhance its passage through the die, the wire may also be copper-coated. If cold drawn wire or rod is used as the starting material, the material may have already been precoated in which case a second precoat treatment can be dispensed with.

The drawing speed is fast enough to move the cooled wire through the lubricant and to the entrance of the die aperture before the temperature of the wire rises substantially above the cooling temperature of step (a).

It will be understood that once the wire is in the die, the work of deformation, the exothermic reaction of transforming austenite to martensite, and the friction may raise the temperature of the wire as much as about 200° C. where the wire was initially at liquid nitrogen temperature. This adiabatic heating effect aids the performance of the conventional lubricants. Generally, the drawing speed is about 100 to about 800 feet per minute for wire diameters of about 0.04 inch to about 0.2 inch. The stated drawing speeds refer to the outgoing wire diameter, i.e., the diameter of the wire as it leaves the die. The drawing speed will be slower for larger diameter wire and faster for wire of thinner diameter, the most desirable speed being determined by the experience of the operator with the particular wire. The application of "back tension" or "back-pull" facilitates the drawing of stainless steel wire at cryogenic temperatures and can be incorporated into step (b).

After cryogenic drawing step (b), the wire or rod is divided into slugs, which are cold headed to provide the fastener as stated in step (c). The term "slug" is used to describe the metal blank to be cold headed. It is generally a cylindrically shaped piece of metal cut from the wire or rod produced in step (b) and has a diameter somewhere in between the ultimate head diameter and ultimate shank diameter of the finished fastener and a length somewhere in between half the length and the full length of the finished fastener. Selection of the diameter and length will depend upon the final fastener geometry and the amount of additional strengthening by extrusion, if any, that is desired. In general, the larger the diameter of the slug relative to the diameter of the finished fastener, the greater the strengthening due to extrusion of the shank.

"Cold heading" is accomplished with the slug and heading apparatus being at atmospheric temperature and involves upsetting the head of the fastener and may also include extrusion of the shank.

The terms "extrusion" (more descriptively, forward extrusion) and "extruding" are used here to mean a deformation process in which a part of a cylindrical metal slug is forced by compression to flow through a suitably shaped aperture in a die to give a product of a smaller but uniform cross section. The die in which the extrusion takes place is of conventional design and can be made of tool steel or tungsten carbide. In terms of the length of a cylindrical slug as measured along the axis of the cylinder, the portion which is extruded can vary within wide limits depending on the final desired shape of the cold headed part. The final head diameter to shank diameter ratio will however usually be less than 3. The reduction in area of the extruded portion, now the shank, is about 10 to about 30 percent and preferably about 15 to about 25 percent. In carrying out step (c), the head portion of the slug is usually enclosed by a conical tool. This conical tool forces the shank into the extrusion die and it is supposed to prevent the head portion from buckling. A partial upsetting may take place, however. Depending on the final fastener geometry and strength desired, the cold heading operation may or may not include such an extrusion. In any case, step (c) is then completed by upsetting part or all of the non-extruded portion of the slug to provide or form the head of the fastener. The term "upsetting" is used here to mean a deformation process wherein the metal is subjected to compressive deformation by a blow or steady pressure generally in the direction of the axis of the slug in order to enlarge the cross sectional area over part of its length. The upsetting dies are of conventional design and can be made out of tool steel or tungsten carbide. The entire cold heading operation takes place at or above atmospheric temperature. Generally, the cold heading temperatures can range from about 15° C. to about 500° C. The preferred temperatures are in the range of about 15° C. to about 50° C. Depending on the alloy and the strength after cryogenic deformation in step (b), a 15 to 25 percent reduction by extrusion will add about 10 to about 40 ksi to the strength of the shank of the fastener.

After step (c), it is preferred that the finished fastener or bolt be aged to optimize strength. Aging is carried out in a conventional manner at a temperature in the range of about 400° C. to about 450° C. Aging time can range from about 30 minutes to about 10 hours and is preferably in the range of about 30 minutes to about 2.5 hours. Conventional testing is used here to determine the temperature and time, which give the highest tensile strength and yield strength.

It will be noted, that aging tends to improve yield strength even more than tensile strength, and for the alloy to reach the highest strength levels can be carried to a point where yield strength approximates the tensile strength.

When the bolt is subjected to aging the tensile strength of the entire bolt is increased by an amount in the range of about 20 ksi (138 Mpa) to about 50 ksi (345 Mpa). This strengthening effect, which is considerably higher than that observed in conventional 300 series fasteners, is a further advantage of the subject process.

The invention is illustrated by the following examples.

EXAMPLES 1 TO 4

In each example, a bolt is produced from AISI 304L stainless steel annealed rod having a tensile strength of 90 ksi (621 Mpa) and a diameter of 0.191 or 0.220 inch. The chemistry of the material is (weight percent):

| | |
|---|---|
| C: | 0.017 |
| Mn: | 0.55 |
| P: | <0.04 |
| S: | 0.006 |
| Si: | 0.54 |
| Cr: | 18.8 |
| Ni: | 8.3 |
| Fe: | balance |

In some examples, the annealed rod is conventionally drawn at room temperature (27° C.) prior to step (a). One rod was given a 9.9 percent area reduction resulting in a 0.209 inch diameter wire with a yield strength of 70 ksi (483 Mpa) and a tensile strength of 99 ksi (683 Mpa). Another rod was given a 16 percent area reduction resulting in a 0.202 inch diameter wire with a yield strength of 86 ksi (593 Mpa) and a tensile of 105 ksi (725 Mpa). Step (a) is carried out in all examples by immersing the rod or wire in liquid nitrogen to cool the material to minus 196° C. Step (b) is then performed and the die size, area reduction, yield strength, and tensile strength attained will be noted hereinafter. The wire is divided into slugs after step (b) and cold-headed on a progressive header in step (c).

The term "progressive header" denotes a conventional solid die machine with two or more separate stations for various steps in the operation. The slug is automatically transferred from one station to the next and the machine can perform one or more extrusions and upsets on the slug. Most progressive headers used in high speed production are fed by coiled wire stock. The stock is fed into the machine by feed rolls and the first step is a cut-off stage which produces cylindrical slugs, each having a 1.3 inch length and a diameter of 0.181 to 0.201 inch. The machines, the punches and the dies are all at about 27° C. (room temperature). The slugs then pass through an extrusion die where 62 percent of the length (0.8 inch) is extruded to provide a shank diameter of 0.168 to 0.183 inch with a reduction in area of 13.8 to 21.5 percent and a shank length of 0.928 to 1.019 inch. The punch speed is 5 inches per second and tungsten carbide extrusion dies are used. The lubricant used during the extrusion is a conventional dry lubricant for stainless steel: a mixture of calcium stearate and lime. The slugs then pass through the upsetting die in which the head is formed, the finished bolt having a shank diameter of 0.168 to 0.183 inch and a head diameter of 0.29 inch. The specific reduction by extrusion and die size used on each of the examples and the resultant yield and tensile strengths will also be noted hereinafter.

After cold heading the cryogenically drawn wire or rod into a fastener as in step (c), the fastener is aged at 400° C. for one hour and the resultant yield and tensile strengths are in the range of 172 ksi (1187 Mpa) to 211 ksi (1456 Mpa). It should be noted that, depending on the initial strength of the fastener, the final aging step increases the strength of the fastener by about 20 to about 50 ksi. Variable details and conditions of the processing history and resultant yield and tensile strengths of the fastener are shown in the following table:

| | | | cold drawn | | | | step (b) | | | | step (c) extrusion | | | | aging | |
|---|---|---|---|---|---|---|---|---|---|---|---|---|---|---|---|---|
| Example | diameter of starting wire (in inches) | annealed | die size (inch) | area reduction (percent) | Y.S. (ksi) | T.S. (ksi) | die size (inch) | area reduction (percent) | Y.S. (ksi) | T.S. (ksi) | die size (inch) | area reduction (percent) | Y.S. (ksi) | T.S. (ksi) | Y.S. (ksi) | T.S. (ksi) |
| 1 | 0.191 | annealed | — | — | — | — | 0.186 | 4.7 | 64 | 123 | 0.168 | 18.7 | 150 | 156 | 172 | 172 |
| 2 | 0.191 | annealed | — | — | — | — | 0.181 | 9.9 | 88 | 146 | 0.168 | 13.8 | 163 | 165 | 190 | 192 |
| 3 | 0.220 | annealed | 0.209 | 9.9 | 70 | 99 | 0.201 | 7.4 | 69 | 134 | 0.183 | 16.7 | 167 | 167 | 199 | 199 |
| 4 | 0.220 | annealed | 0.202 | 16.0 | 86 | 105 | 0.193 | 9.1 | 86 | 143 | 0.171 | 21.5 | 175 | 175 | 211 | 211 |

Y.S. = 0.002 offset yield strength
T.S. = ultimate tensile strength

I claim:

1. A method for making a fastener having a head and a shank from wire or rod consisting essentially of AISI 200 or 300 series stainless steel comprising the following steps:
   (a) cooling the wire or rod to a temperature of less than about minus 75° C.;
   (b) drawing the cold wire or rod through a die at a strain sufficient to provide a tensile strength for the wire or rod in the range of about 75 ksi to about 160 ksi, the strain and the die size being such that the area of the wire or rod will be reduced by at least about 3 percent; and
   (c) dividing the wire or rod into slugs and cold heading each slug to provide the fastener.

2. The method defined in claim 1 wherein the initial $Md_{30}$ temperature of the wire or rod is in the range of about minus 50° C. to about 50° C. and the initial tensile strength of the wire or rod is in the range of about 70 ksi to about 125 ksi, and the tensile strength provided in step (b) is higher than the tensile strength of the wire or rod entering step (b).

3. The method defined in claim 1 wherein the initial wire or rod is cold drawn.

4. The method defined in claim 1 wherein the initial wire is annealed.

5. The method defined in claim 1 wherein in step (b):
   (i) the reduction in area of the wire or rod is in the range of about 3 to about 25 percent; and
   (ii) the tensile strength after such reduction is in the range of about 90 to about 160 ksi.

6. The method defined in claim 1 wherein, after step (c), the fastener is aged at a temperature in the range of about 400° C. to about 450° C.

7. The method defined in claim 1 wherein the temperature in step (a) is less than about minus 100° C.

8. The method defined in claim 1 wherein the wire or rod used in step (a) is made from wire or rod drawn at a temperature in the range of about 20° C. to about 200° C. to provide a reduction in area of about 5 percent to about 30 percent and a tensile strength of about 75 ksi to about 125 ksi, and the tensile strength provided in step (b) is higher than the tensile strength of the wire or rod entering step (b).

9. The method defined in claim 1 wherein the wire or rod consists essentially of AISI 300 series stainless steel.

* * * * *